United States Patent [19]

Smith et al.

[11] 4,359,660

[45] Nov. 16, 1982

[54] SERIES DIODE X-RAY SOURCE

[75] Inventors: Ian D. Smith, Alameda; Laszlo J. Demeter, Oakland; Kurt E. Nielsen, Castro Valley, all of Calif.

[73] Assignee: Physics International Company, San Leandro, Calif.

[21] Appl. No.: 216,165

[22] Filed: Dec. 15, 1980

[51] Int. Cl.[3] ..... H01J 35/00

[52] U.S. Cl. ..... 378/119; 313/2.1

[58] Field of Search ..... 313/56, 2; 250/402

[56] References Cited

U.S. PATENT DOCUMENTS

| | | | |
|---|---|---|---|
| 1,920,601 | 8/1933 | Slack | 378/124 |
| 2,948,822 | 8/1960 | Paroselli | 313/56 |
| 3,267,315 | 8/1966 | Hofmann | 313/56 |
| 3,452,203 | 6/1969 | Shiga et al. | 378/113 |
| 3,452,232 | 6/1969 | Seki et al. | 313/56 |
| 3,821,580 | 6/1974 | Alexandrovich et al. | 313/56 |
| 3,946,261 | 3/1976 | Holland et al. | 313/56 |
| 3,970,884 | 7/1976 | Golden | 313/55 |
| 4,017,757 | 4/1977 | DeCou, Jr. | 313/56 |
| 4,065,690 | 12/1977 | Maeyama | 313/57 |
| 4,126,803 | 11/1978 | Bader et al. | 313/55 |

*Primary Examiner*—Robert Segal

*Attorney, Agent, or Firm*—Robert R. Tipton

[57] ABSTRACT

A multiple cathode-anode pulsed X-ray source utilizes a first X-ray transparent cathode spaced apart from a solid tungsten first anode between which is disposed a second tungsten anode spaced apart from the first cathode and electrically connected to a second X-ray transparent cathode which is also spaced apart from a solid tungsten first anode. Electrons emitted from the first cathode are caused to bombard the second anode to emit X-radiation therefrom where the electrons are then conducted to and emitted by the second cathode to bombard the first anode to again emit X-radiation therefrom. The X-radiation emitted from the first and second anodes passes through the first and second cathodes to a target.

10 Claims, 7 Drawing Figures

SERIES DIODE X-RAY SOURCE

BACKGROUND OF THE INVENTION

This invention relates generally to X-ray sources, and in particular to multiple cathode-anode X-ray sources.

The multiple cathode X-ray tubes of the prior art generally used the multiple cathodes to produce separate energy level X-rays or multiple images to achieve a three-dimensional perspective for better analysis of the subject being irradiated.

Other multiple anode X-ray sources were used to create a uniform or homogenious X-ray field by the arrangement of the various anodes. Such sources were particularly adapted to irradiate various substances to alter their physical, chemical or biological characteristics.

Still other dual or multiple cathode X-ray sources used each cathode for different purposes such as one cathode for fluoroscopy purposes and the other cathode for direct photography.

In all the prior art X-ray sources, the total current accelerated was equal to that provided by the Generator. The present invention provides a method of accelerating currents greater than the generator current by using the generator current more than once.

SUMMARY OF THE INVENTION

The apparatus of the present invention has low voltage diode X-ray sources arranged in a series configuration. The apparatus of the present invention thus includes the advantage of using the generator current more than once by driving multiple cathode-anode sources in series.

A further advantage of the apparatus of the present invention includes providing a dual feed configuration. The opposing magnetic fields of the dual feeds reduce the pinch effect a high current densities and thus reduces the loss of electrons bypassing the intermediate electrode.

Basically, the X-ray source of the present invention comprises a first X-ray transparent cathode which is spaced apart from a first anode, between which is disposed an electrically floating second anode which is electrically connected to a second X-radiation transparent cathode. Electrons from an electrical current source are caused to be emitted from the first cathode and bombard the second anode to emit X-radiation. The electrons are then conducted to the second cathode where they are caused to be emitted and bombard the first anode to emit X-radiation.

A further embodiment of the present invention utilizes a dual current feed to the first cathode and, because of inductance considerations, a dual feed to each subsequent cathode.

It is, therefore, an object of the present invention to provide a multiple cathode-anode X-ray source.

It is another object of the present invention to provide a multiple cathode-anode X-ray source by which the generator current is used more than once.

It is another object of the present invention to provide a source of X-radiation having a high intensity output at a low voltage.

It is still a further object of the present invention to provide a source of X-radiation having an efficient transformation of electrical energy into X-radiation.

It is still a further object of the present invention to provide an X-ray source utilizing a dual current feed to the cathodes by which low voltage, high current density multiple cathode-anode X-ray sources can be used in series.

These and other objects of the present invention will become manifest upon study of the following detailed description when taken together with the drawings.

DESCRIPTION OF THE PREFERRED EMBODIMENTS

Figure 1:
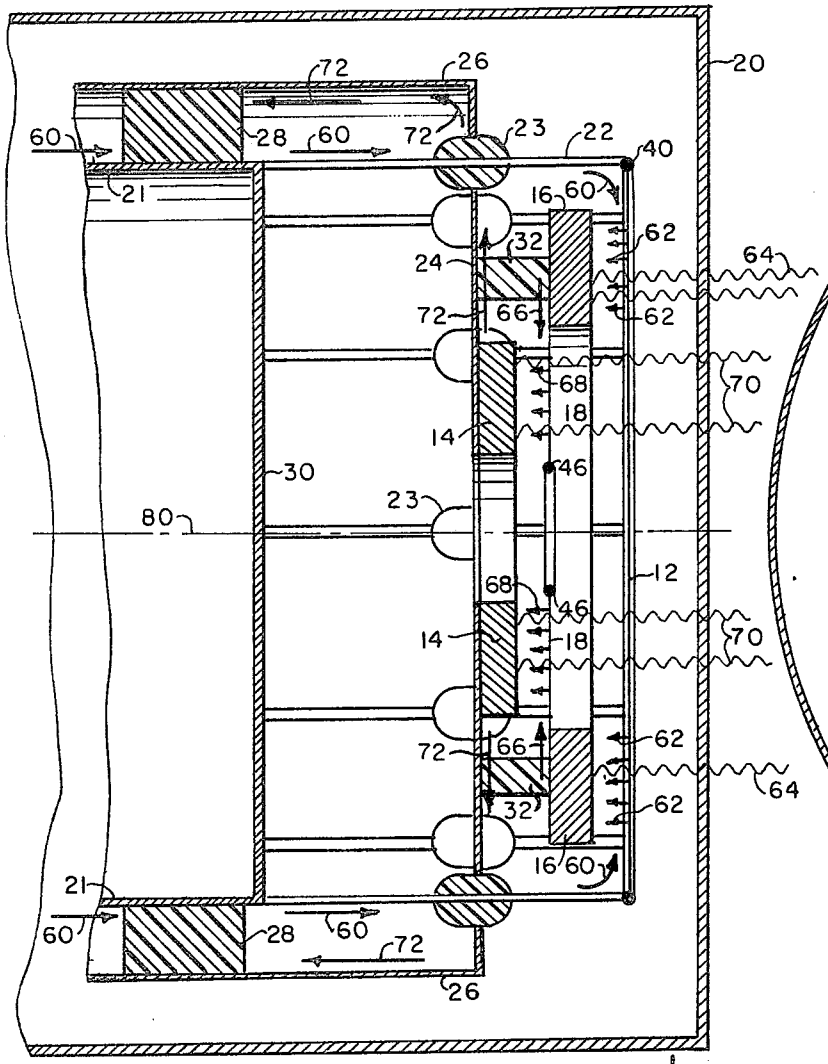
FIG. 1 is a cross-sectional elevational view of the multiple cathode-anode X-ray source of the present invention in which the outer diameter of the first anode is less than the inner diameter of the second anode.

With reference to FIG. 1, there is illustrated a first embodiment of the X-ray source of the present invention comprising, basically, a first cathode 12, a first tungsten anode 14 disposed parallel to and spaced apart from cathode 12, a second tungsten anode 16 electrically connected to second cathode 18, also disposed parallel to and spaced apart between first cathode 12 and first anode 14. A vacuum tight, X-ray transparent housing 20 is arranged to enclosed the multiple cathode-anode configuration of FIG. 1 and is evacuated to a high vacuum by means of vacuum pumps (not shown) well known in the art. Also, diode impedance is decreased because First cathode 12 defines a generally planar X-ray transparent grid and is connected about its outer periphery to the negative side of a source of electrical current (not shown) common in the art, through electrical conducting members 21 and 22. Insulators 23 or radiused ports are used to electrically insulate conductors 22 where they pass through electrical conducting plate 24.

Electrical conductors 22 are arranged as extended members electrically connecting the end of cylindrical conductor 21 to first cathode 12. Although conductors 22 are shown connected to conductor 21 proximate conducting end plate 30, the end of cylindrical conductor 21 could extend to a point near insulators 23 before being connected to conductors 22 in order to take full advantage of its coaxial relationship to outer cylindrical conductor 26.

First anode 14 is electrically connected to the ground side of previously referred to electrical current source (not shown) common in the art, through electrically conducting plate member 24 which is, in turn, electrically connected to electrically conducting cylindrical member 26.

Electrically conducting cylindrical member 26 is also arranged to be coaxial with cylindrical conductor 21 being spaced apart therefrom by electrical insulator spacer members 28.

A conducting end plate 30 is used to maintain the end portion of conducting member 22 in a cylindrical shape, and, together with insulators 28 and conductors 26, serves as a liquid-to-vacuum seal.

Second anode 16 is held in spaced apart relation between first cathode 12 and first anode 14 by means of insulated spacer blocks 32.

Electron emission for the cathodes can be controlled through various techniques such as surface heating, surface conditioning or by cathode-anode spacing.

In the illustrated embodiment, electron emission from first cathode 12 to second anode 16 is controlled by the spacing of the surface of second anode 16 from first cathode 12 which is less than the spacing of second cathode 18 from first cathode 12. The same is true for the spacing of second cathode 18 from the surface of first anode 14 which is less than the spacing of the back of second anode 16 from conducting plate 24.

Figure 2:
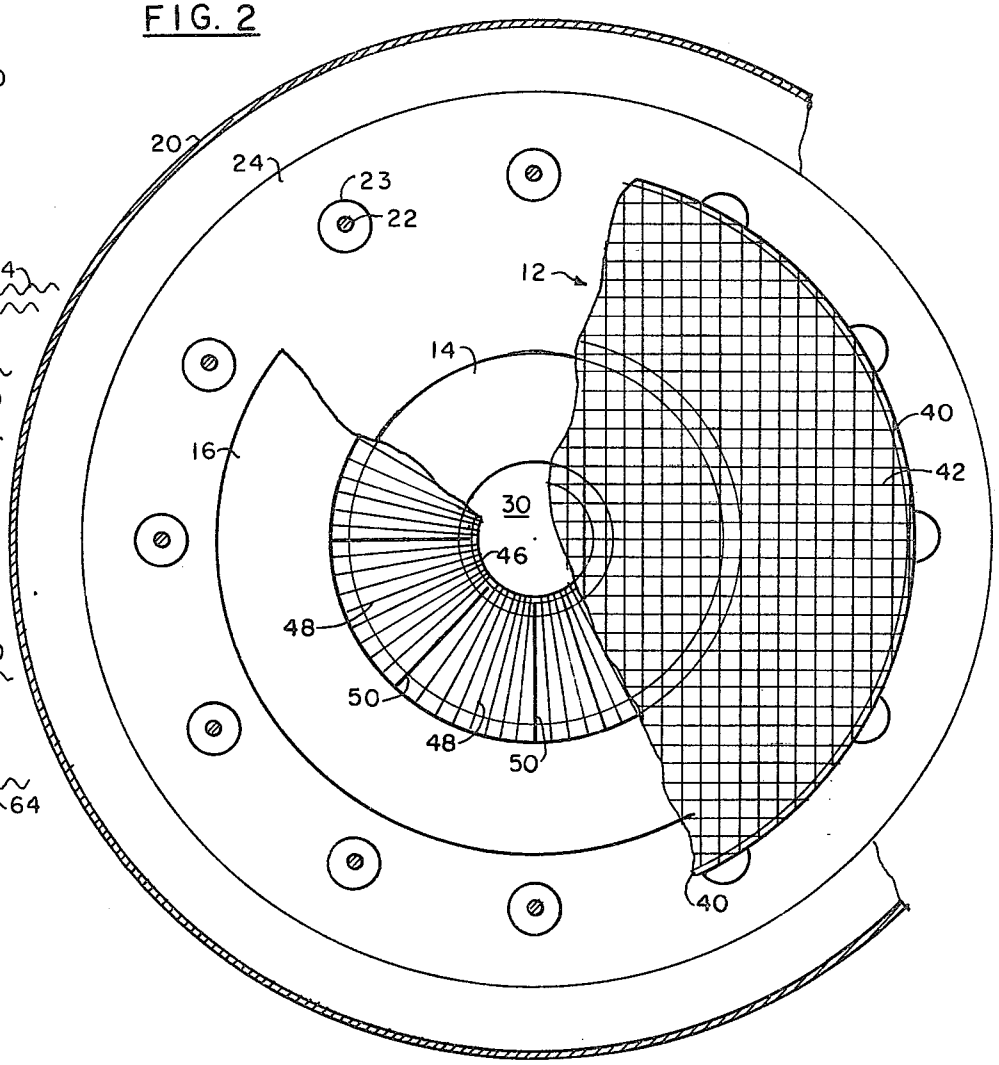
FIG. 2 is a partial cut-away view of the apparatus of FIG. 1 taken at lines 2—2.

With reference to FIG. 2, first cathode 12 comprises a peripheral support ring 40 on which are attached electrically conductive wires 42 spaced apart from each other to define a grid to permit the X-radiation emitted from second anode 16 and first anode 14 to pass therethrough.

Still with reference to FIG. 2, second cathode 18 comprises an inner support ring 46 on which is attached one end of spaced apart electrically conductive support wires 48 in the manner of spokes of a wheel. The other end of support wires 48 are attached to the underside of second anode 16.

For additional rigidity and support, a conductive support wire or rod 50 is located at equi-angular spacing and attached to both second anode 14 and inner support ring 46.

Second cathode 18 thus defines a generally X-ray transparent annular ring comprising a plurality of fine, spaced apart wires arranged spoke-like to allow X-rays emitted by first anode 14 to pass therethrough.

To operate the apparatus of FIGS. 1 and 2, a pulse of electrical current (negative) from an electrical current source (not shown) common in the art, is caused to flow through inner cylindrical conductors 21 and 22 in the direction of arrows 60.

Upon reaching first cathode 12, the electrical current then disperses through the wire grid formed by conductors 42, where the electrons are caused by the potential difference between anode 16 and cathode 12 to be emitted therefrom toward second solid tungsten anode 16, as shown by arrows 62, to bombard the surface of anode 16 and emit X-radiation therefrom as indicated by wave symbol 64.

The current is then conducted from second anode 16 to conducting wires 48 and 50 of second cathode 18, as indicated by arrows 66, where the potential difference between anode 14 and cathode 18 causes electrons to be emitted from cathode 18 as indicated by arrows 68 and bombard the surface of first solid tungsten anode 14 to emit X-rays therefrom as indicated by wave symbol 70.

The current then returns to the ground side of the electrical current source (not shown), as indicated by arrows 72, through outer conductor 26.

Electrons are accelerated twice in separate diodes in series for greater utilization of generator current.

Although the X-ray source configuration of FIGS. 1 and 2 will provide an efficient utilization of generator current, where it is desired to utilize high current densities and have a relatively low impedance, there is a potential limitation in the use of such a configuration. This limitation is due to the self-magnetic fields created by the high density current which tends to pinch the electron beam toward the center of the configuration along axis of rotation or centerline 80 (FIG. 1). This could result in the pinching of the beam of electrons emitted from first cathode 12 toward centerline 80 and first anode 14, causing the emitted electrons to bypass second anode 16. For such higher current densities, the X-ray source configuration of FIGS. 3 and 4 can be used.

Figure 3:
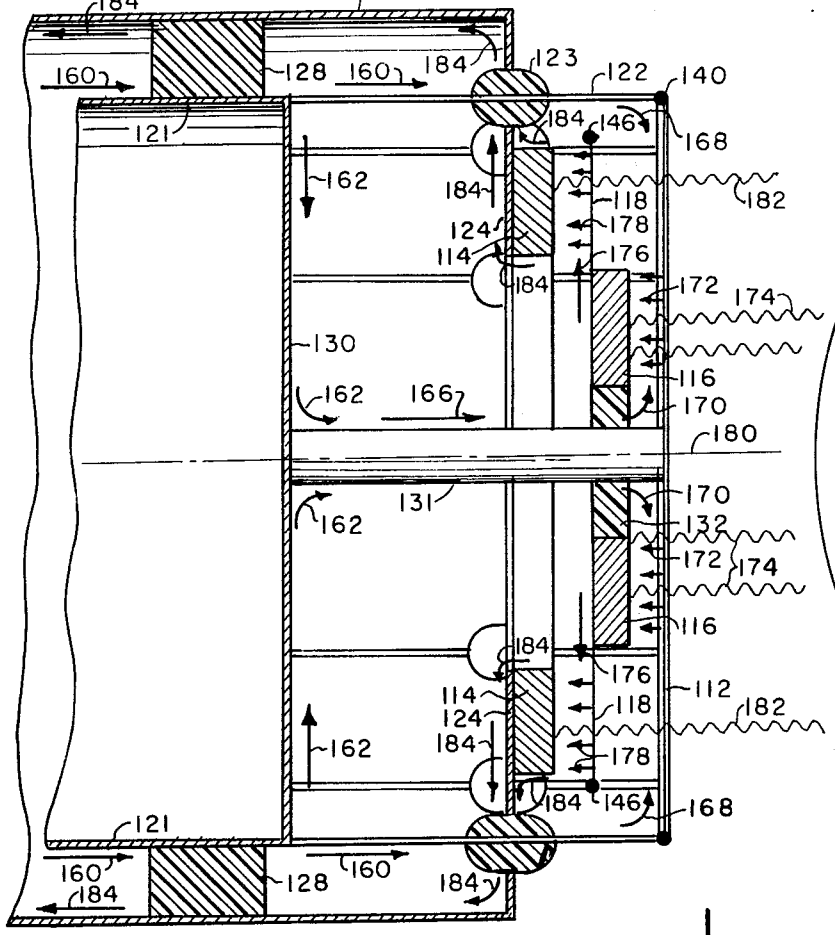
FIG. 3 is a cross-sectional elevational view of a further embodiment of the present invention in which the inner diameter of the of the first anode is greater than the outer diameter of the second anode and in which the first cathode is provided with a dual feed path for the electrons to be emitted therefrom.

With reference to FIG. 3, there is illustrated a cross-sectional elevational view of a further embodiment of the multiple cathode-anode X-ray source of the present invention in which the inner diameter of the first anode is greater than the outer diameter of the second anode. This configuration is used to achieve higher density electrical currents and avoid the tendency of the electron beam emitted from the cathodes to pinch towards centerline or axis of rotation of the circular configuration.

Figure 4:
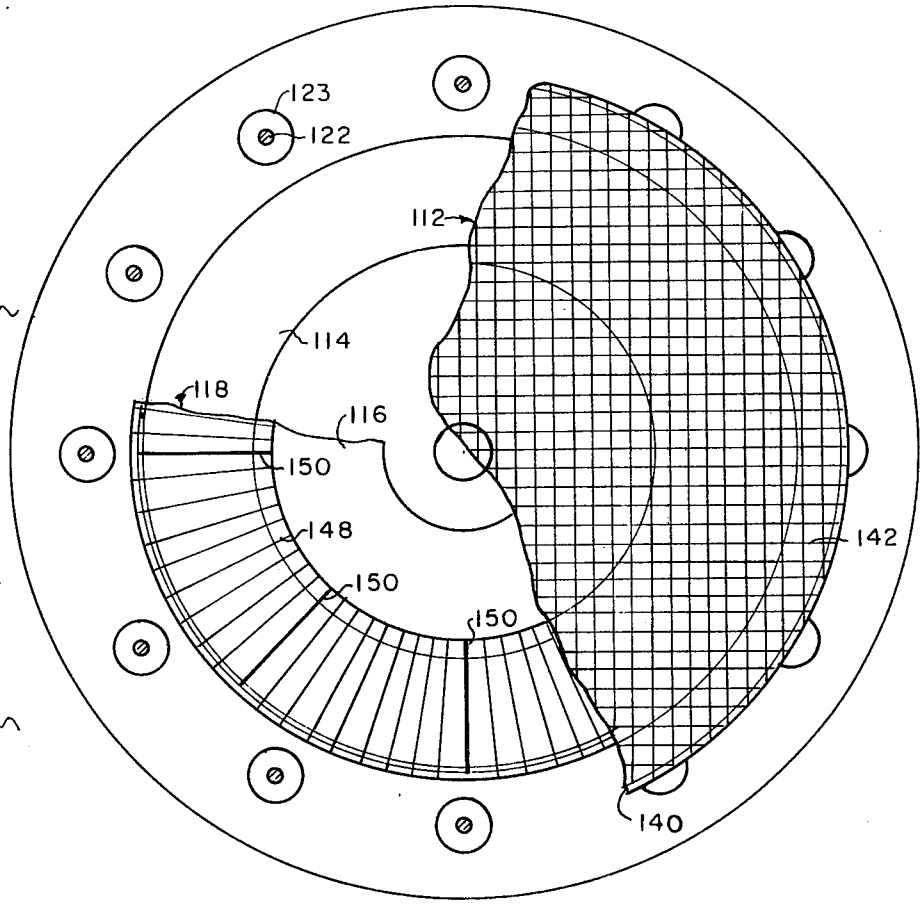
FIG. 4 is a partial cut-away view of the apparatus of FIG. 3 taken at lines 4—4.

FIG. 4 is a partial cut-away view of the apparatus of FIG. 3 taken at lines 4—4.

With reference to FIG. 3, the second embodiment of the X-ray source of the present invention comprises, basically, a first X-ray transparent cathode 112, a first solid tungsten anode 114 disposed parallel to and spaced apart from cathode 112, a second solid tungsten anode 116 electrically connected to second X-ray transparent cathode 118 also disposed parallel to and spaced apart between first cathode 112 and first anode 114. A vacuum tight housing 120 is arranged to enclose the multiple cathode-anode configuration of FIG. 3 and is evacuated to a high vacuum by means (not shown) well known in the art.

First cathode 112 is connected about its outer periphery to the negative side of a source of electrical current (not shown) common in the art, through electrical conducting members 121 and 122.

Insulating members 123 are used to electrically insulate electrical conductors 122 from conductor 126.

Anode 114 is electrically connected to the ground side of the previously referred to electrical current source (not shown) common in the art, through electrical plate member 124 which is, in turn, electrically connected to electrically conductive cylindrical member 126.

Electrically conducting cylindrical member 126 is arranged to be coaxial with conductor 121 utilizing electrical insulation spacer member 128 to maintain the coaxial relationship throughout its length.

A conducting end plate 130 is used to maintain the end portion of conducting member 122 in a cylindrical configuration.

Electrical conductors 122 are connected about the peripheral rim of first cathode 112 and extend to electrically connect cylindrical conductor 121 to first cathode 112. Although conductors 122 are shown connected to cylindrical conductor 121 proximate conducting end plate 130, the end of cylindrical conductor 121 could extend to a point near insulators 123 before being connected to conductor 121 in order to take full advantage of its coaxial relationship to outer cylindrical conductor 126.

In addition, a conducting post member 131, disposed coincident with the axis rotation or centerline 180 of the apparatus, is electrically connected to conducting end plate 130 and the center of first cathode 112.

Second anode 116 is held in spaced apart relation between first cathode 112 and first anode 114 by insulated spacer block 132 which is also attached to conducting post member 131. As an alternative, second anode 116 could be supported by an insulated block or post member attached to conducting end plate 130.

With reference to FIG. 4, first cathode 112 comprises a peripheral spacer ring support 140 on which are attached electrical conducting wires 142 spaced apart from each other to permit the X-radiation emitted by second anode 116 and first anode 114 to pass therethrough.

Still with reference to FIG. 4, second cathode 118 comprises an outer support ring 146 on which is attached one end of spaced apart electrically conductive support wires 148. The other end of support wires 148 is attached to the underside of second anode 116.

For added rigidity and support, conducting support rods or wires 150 are located at equi-angular spacing and are attached to both second anode 114 and outer support ring 146 in a like manner as wires 148.

Second cathode 118 thus defines a generally X-radiation transparent annular ring to allow X-rays emitted by first anode 114 to pass therethrough.

The operation of the apparatus of FIGS. 3 and 4 is similar to that for FIGS. 1 and 2, however the current flow is markedly different to avoid the pinching effect of high current densities.

In the apparatus of FIGS. 3 and 4, a pulse of electrical current (negative) from an electrical current source (not shown) common in the art, is caused to flow in inner cylindrical conductor 121 in the direction of arrows 160. Upon reaching the junction of conducting end plate 130 and conductor 122, the current flow is divided as shown by arrows 162 and 164, with a portion of the current, as indicated by arrows 162, travelling to the center portion of conducting end plate 130 where the current is then conducted through electrically conducting post 131, as indicated by arrows 166. The current flowing in conducting member 122, as shown by arrows 164, continues on to the outer peripheral conducting support 140 of first cathode 112 where it is then dispersed through the grid defined by conducting wires 142, as shown by arrow 168.

Concurrently, the current passing through conducting post 131, as shown by arrows 166, also flows into and is dispersed through the grid defined by wires 142 of first cathode 112, as shown by arrows 170.

Upon entering first cathode 112, the electrical current dispersed through the wire grid formed by conductors 142 is then caused to be emitted therefrom toward second anode 116, as shown by arrows 172, to bombard the surface of anode 116 to emit X-radiation as indicated by the wave symbol 174.

The current is conducted from second anode 116 to second cathode 118 and through conducting wires 148 and 150 as indicated by arrows 176, to be emitted from second cathode 118 to bombard the surface of first anode 114 and emit X-radiation, as indicated by wave symbol 82.

The current then returns to the ground side of the current source (not shown) as indicated by arrows 184 through electrical conducting plate 124 and cylindrical conducting member 126.

Thus electrons are accelerated twice in separate diodes in series for greater utilization of generator current.

It will be noted that the current following parallel paths through central conducting post 131 and cylindrical arranged conducting members 122 tends to reduce the magnetic field in the area of second cathode 118 and second anode 116, thus reducing the pinch effect at high current densities. As can be seen in FIGS. 3 and 4, the magnetic fields created by the high current flow not only tending to pinch the beam inwardly, such as the current through conductors 122, but there are also created magnetic fields which tend to pinch the beam outwardly, such as the magnetic field caused by the current through central post member 131. The combined result is the containment of the electron beam on the annular anode surfaces.

In addition, the two current feeds in parallel yield a lower inductance than either mode alone. Impedance is decreased because each dual feed diode is really two diodes in parallel.

For the configurations of FIGS. 3 and 4, central conducting post member 131 could be removed and anode 116 extended to the centerline 180. This, of course, would increase the pinch effect on the anodes, because of the higher magnetic field associated with the single current path. Any pinching of the beam of electrons coming from cathode 118 may cause a portion of the electrons to miss first anode 114 inside the inner diameter of anode 114 and behind second anode 116. There would be only a loss in utilization of electrons. The electrons from second cathode 118 would be deflected toward axis of rotation or centerline 180 and would therefore be lost from bombardment of first anode 114.

Figure 7:
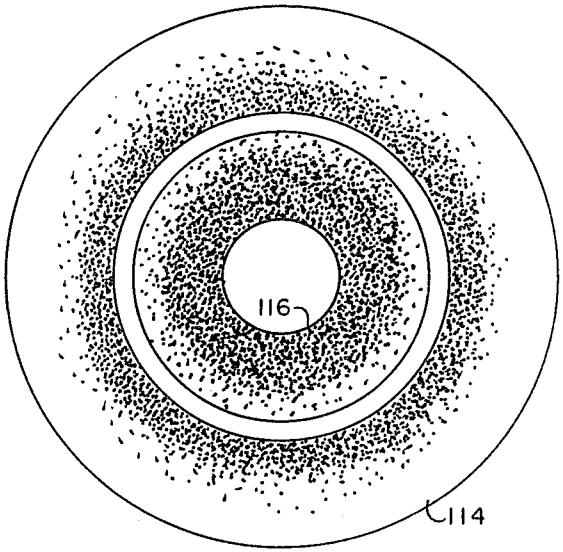
FIG. 7 is a representation of an X-ray pin-hole camera photograph of the dual feed multiple diode X-ray source of FIG. 4 for a ratio of outer current to inner current of 2.8.
Figure 6:
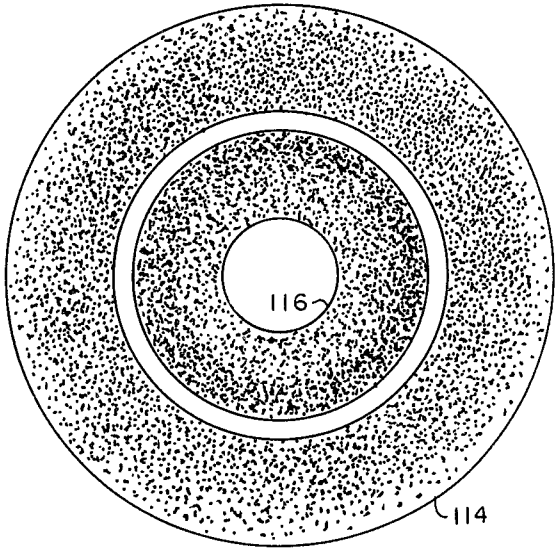
FIG. 6 is a representation of an X-ray pin-hole camera photograph of the dual feed multiple diode X-ray source of FIG. 4 for a ratio of outer current to inner current of 1.7.
Figure 5:
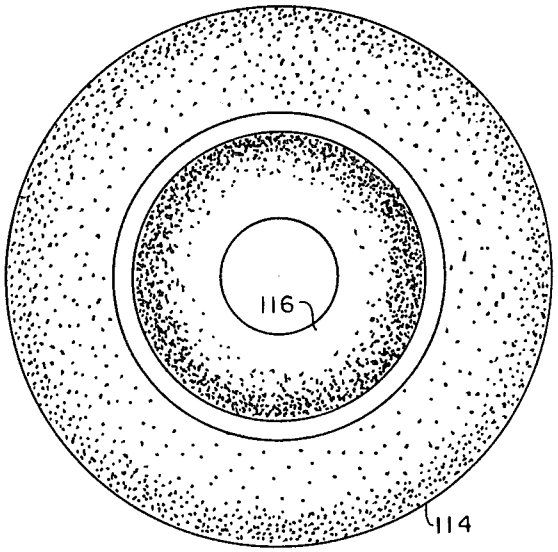
FIG. 5 is a representation of an X-ray pin-hole camera photograph of the dual feed multiple diode X-ray source of FIG. 4 for a ratio of outer current to inner current of 1.3.

With reference to FIGS. 5, 6 and 7, there is illustrated a representation of an X-ray pin-hole camera picture of the surface of first anode 114 and second anode 116 of the dual feed configuration of FIGS. 3 and 4. The dots or stippling represent the intensity of X-radiation which, of course, is generally proportional to the number or density of electrons bombarding each anode.

By adjusting the ratio of outer current I(o) feeding the outside edge of first cathode 112 though peripheral spacer ring support 140, to inner current I(i) feeding first cathode 112 through conducting post member 131, the concentration of electrons by the magnetic pinch effect can be controlled.

As previously described, if conducting center post 131 were removed and the inner diameter of second anode 116 reduced to centerline 180 thus enlarging the surface area of anode 116, the pinch effect on the electrons emitted by cathodes 112 and 118 would be increased. This would case a portion of the electrons emitted by cathode 118 to miss first anode 114 and flow inside the inner diameter of anode 114 and behind anode 116.

With reference to FIG. 5, the X-radiation distribution is shown where the ratio of outer current I(o) to inner current I(i), I(o)/I(i), is 1.3. The pinch effect caused by the flow of current in central conducting post 131 tends to cause the flow of electrons emitted from cathode 112 and accelerated to anode 116 to move radially away from central conducting post 131 and strike, for the most part, the area of anode 116 proximate its outer peripheral edge. The inner edge of anode 116 is shown to emit little, if any, X-radiation indicating few electrons are bombarding this region of the anode.

With reference to FIG. 6, the X-radiation distribution is shown where the ratio of outer current I(o) to inner current I(i), I(o)/I(i), is 1.7. The pinch effect caused by the current in central conducting post 131 is almost equal to the pinch effect caused by the flow of current in outer conductors 122. The X-radiation and, therefore, electron density, is fairly evenly distributed over the entire surface of anodes 116 and 114.

With reference to FIG. 7, the X-radiation distribution is shown where the ratio of outer current I(o) to inner current I(i), I(o)/I(i), is 2.8. The pinch effect caused by the current in outer conductors 122 is greater than the pinch effect caused by the current in inner conducting post 131. Thus, the electrons emitted by cathodes 112 and 118 are caused to flow toward centerline 180 and, for the most part, bombard the inner edges of anodes 114 and 116 as shown by the greater density of stippling in FIG. 7.

Thus, by controlling the ratio of current flow between the inner and outer current feed paths, such as, by varying the inductive reactance of those paths, the vector motion of the electrons emitted by the cathodes can be controlled to provide full utilization of the electrons at the anodes. For example, this inductive reactance can be adjusted by decreasing or increasing the diameter of conducting post 131, or by increasing or decreasing the number of conductors 122, or by employing flux excluders in the region of current arrows 162 and 168. The ratio of current in the inner current feed path defined by arrows 162 and 170, relative to the outer current feed path defined by arrows 164 and 168, will be inversely proportional to the inductive reactance of these two paths. Thus, by increasing the inductive reactance of the current feed path defined by arrows 162 and 170, the current through central electrode will be reduced. In a like manner, by increasing the inductive reactance in the current feed path defined by arrows 164 and 168, the current to outer peripheral conducting support 140 will be reduced.

It can be seen that the dual current feed configuration of FIG. 3 can also be applied to the double diode arrangement of FIG. 1. As in the case of the dual diode feed configuration of FIG. 3, the ratio of inner to outer currents must be adjusted to prevent the "pinch" from causing electrons to be deflected away from anodes 14 and 16.

We claim:

1. A multiple cathode X-ray source comprising means for generating electrical energy having a current source and a ground, a first generally planar X-ray transparent cathode connected to said current source, a first anode connected to said ground and having its surface disposed generally parallel to and spaced apart from said first cathode comprising a generally planar tungsten surface, a second anode disposed generally parallel to and spaced apart between said first cathode and said first anode comprising a generally planar tungsten surface, a second generally planar X-ray transparent cathode electrically connected to said second anode and disposed parallel to and spaced apart between said first cathode and said first anode, and means defining an evacuated housing enclosing said anodes and said cathodes.

2. The multiple cathode-anode X-ray source as claimed in claim 1 wherein said first cathode comprises a plurality of spaced apart electrically conductive wires arranged to define a generally planar circular member.

3. The multiple cathode-anode X-ray source as claimed in claim 1 wherein said first anode comprises a generally planar annular ring member, and said second anode comprises a generally planar annular ring member.

4. The multiple cathode-anode X-ray source as claimed in claim 3 wherein the outer diameter of said second anode is greater than the inner diameter of said first anode.

5. The multiple cathode-anode X-ray source as claimed in claim 3 wherein the outer diameter of said first anode is less than the inner diameter of said second anode.

6. The multiple cathode-anode X-ray source as claimed in claim 1 wherein said second cathode comprises a generally planar annular ring member electrically connected to said second anode comprising a plurality of spaced apart wires extending radially from said second anode.

7. The multiple cathode-anode X-ray source as claimed in claim 2 further comprising means for electrically connecting said first cathode to said current source proximate the peripheral edge of said first cathode, and means for electrically connecting said first cathode to said current source proximate the center of said first cathode.

8. The multiple cathode-anode X-ray source as claimed in claim 7 further comprising means for controlling the ratio of currents flowing to said peripheral edge of said first cathode and said center of said first cathode.

9. A multiple cathode-anode X-ray source comprising means for generating electrical energy having a current source and a ground, a first cathode connected to said current source comprising an electrically conductive, generally planar, X-ray transparent member electrically connected proximate its center and proximate its peripheral edge to said current source, a first anode connected to said ground comprising a first annular tungsten ring member having a generally planar surface connected to said ground, said first annular ring disposed parallel to and spaced apart from said first cathode proximate and said first cathode, a second anode comprising a second annular tungsten ring having a generally planar surface, said second annular ring disposed parallel to and spaced apart from said first cathode and disposed between said first cathode and said first anode, said second anode having an outer diameter less than the inner diameter of said first anode, with the spacing of said second anode from said first cathode being less than the spacing of said first anode from said first cathode, a second cathode electrically connected to said second anode comprising an electrically conductive, generally planar third annular ring X-ray transparent member having an outer and inner diameter at least proximate the outer and inner diameters of said first anode, said second cathode disposed parallel to and spaced apart from said first anode, the spacing of said second cathode from said first anode being less than the spacing of said second cathode from said first cathode, means defining an evacuated housing enclosing said anodes and said cathodes.

10. The multiple cathode-anode X-ray source as claimed in claim 9 further comprising means for controlling the flow of current to the center of said first cathode, means for controlling the flow of current to the peripheral edge of said first cathode, and means for controlling the ratio of currents flowing to said center and peripheral edge of said first cathode.

* * * * *